US005335861A

United States Patent [19]

Matusaka

[11] Patent Number: 5,335,861

[45] Date of Patent: Aug. 9, 1994

[54] FUEL INJECTING APPARATUS

[75] Inventor: Masanobu Matusaka, Toyota, Japan

[73] Assignee: Aisin Seiki Kabushiki Kaisha, Kariya, Japan

[21] Appl. No.: 996,107

[22] Filed: Dec. 23, 1992

[30] Foreign Application Priority Data

Dec. 27, 1991 [JP] Japan ..... 3-347017

[51] Int. Cl.[5] ..... F02M 51/06; F02M 61/08

[52] U.S. Cl. ..... 239/533.7; 239/533.8; 239/533.12; 239/584

[58] Field of Search ..... 239/533.7, 533.8, 533.9, 239/533.12, 584, 585.1

[56] References Cited

U.S. PATENT DOCUMENTS

| | | | |
|---|---|---|---|
| 4,033,507 | 7/1977 | Frömel et al. | 239/585.1 X |
| 4,164,326 | 8/1979 | Deckard | 239/585.1 X |
| 4,728,074 | 3/1988 | Igashira et al. | 239/584 X |
| 4,909,440 | 3/1990 | Mitsuyasu et al. | 239/533.8 X |
| 5,104,046 | 4/1992 | Sakagami | 239/585.4 X |

FOREIGN PATENT DOCUMENTS 2190682 7/1990 Japan .

*Primary Examiner*—Andres Kashnikow
*Assistant Examiner*—William Grant
*Attorney, Agent, or Firm*—Oblon, Spivak, McClelland, Maier & Neustadt

[57] ABSTRACT

A fuel injecting apparatus for injecting an amount of fuel into an engine is comprised of a housing, a nozzle connected to the housing and extending into the engine, a driving device disposed in the housing, a valve member fitted slidably in the nozzle, terminated outside the nozzle so as to be opposed thereto, and operated to open and close the nozzle when the driving device is turned on and turned off, respectively, a pressure chamber defined within the housing so as to be opposed to the lower side of the driving device, a first fuel chamber formed within the housing to which fuel is being supplied continually, a second fuel chamber formed between the housing and the nozzle, a measuring device disposed between the first fuel chamber and the second fuel chamber for determining the amount of fuel to be injected, a plunger disposed slidably between the pressure chamber and the first fuel chamber for establishing and interrupting the fluid communication between the first fuel chamber and the second fuel chamber.

5 Claims, 2 Drawing Sheets

FUEL INJECTING APPARATUS

BACKGROUND OF THE INVENTION

1. Field of the invention

This invention relates to a fuel injecting apparatus and in particular to a fuel injecting apparatus used for injecting an amount of fuel under a high pressure to a cylinder of an engine.

2. Description of the Related Art

A conventional fuel injecting apparatus is disclosed in the Japanese Patent publication No. 2-190,682. The conventional fuel injecting apparatus, as shown in FIG. 2, includes a fluid passage 109, a pressure chamber 113 connected to the fluid passage 109, and a valve member 103 disposed between the fluid passage 109 and the pressure chamber 113 which is operated by an axial length change of a piezoelectric actuator 118. That is to say, when the actuator 118 is shrunk or contracted, pressure in the pressure chamber 113 decreases. Then, the valve member 103 is moved upward by the fuel pressure applied to a pressure receiving surface 111 and opens an injecting port 102, which results in the fuel injection from the injection port 102 into a combustion chamber of an engine.

On the other hand, when fuel pressure in the pressure chamber 113 becomes high upon extension of the actuator 118, the valve member 103 is moved downward by pressure in the pressure chamber 113 and closes the port 102. The fuel injection is terminated.

However, in the conventional fuel injecting apparatus, since the injecting port 102 is extended into the combustion chamber of the engine, the valve member 103 may be forced to open by the explosion in the combustion chamber of the engine, which results in an unexpected fuel injection from the injecting port 102. In addition, though the amount of fuel to be injected depends on the radius of the injecting port 102, the the radius of the injecting port 102 may be varied due to adhesion of carbon thereto or thermal change in the combustion chamber, which leads to an incorrect fuel injection.

SUMMARY OF THE PRESENT INVENTION

It is, therefore, an object of the present invention to provide the fuel injecting apparatus which prevents the valve member from opening by means of the explosion in the combustion chamber of the engine and is able to inject constantly a predetermined quantity of the fuel to the chamber.

To achieve the above mentioned object, this invention provides a fuel injecting apparatus for injecting an amount of fuel into an engine and is comprised of a housing, a nozzle connected to the housing and extending into the engine, a driving device disposed in the housing so as to be operatively connected to the nozzle, a valve member fitted slidably in the nozzle, terminated outside the nozzle so as to be opposed thereto and operated to open and close the nozzle when the driving device is turned on and turned off, respectively, a pressure chamber defined within the housing so as to be opposed to the lower side of the driving devices, a first fuel chamber formed within the housing to which fuel is being supplied continually, a second fuel chamber formed between the housing and the nozzle, a measuring device disposed between the first fuel chamber and the second fuel chamber for determining the amount of fuel to be injected, and a plunger disposed slidably between the pressure chamber and the first fuel chamber for establishing and interrupting the fluid communication between the first fuel chamber and the second fuel chamber.

BRIEF DESCRIPTION OF THE DRAWINGS

The features and advantages of the fuel injecting apparatus according to the present invention will be more clearly appreciated from the following description in conjunction with the accompanying drawings wherein.

DETAILED DESCRIPTION OF A PREFERRED EMBODIMENT

Figure 1:
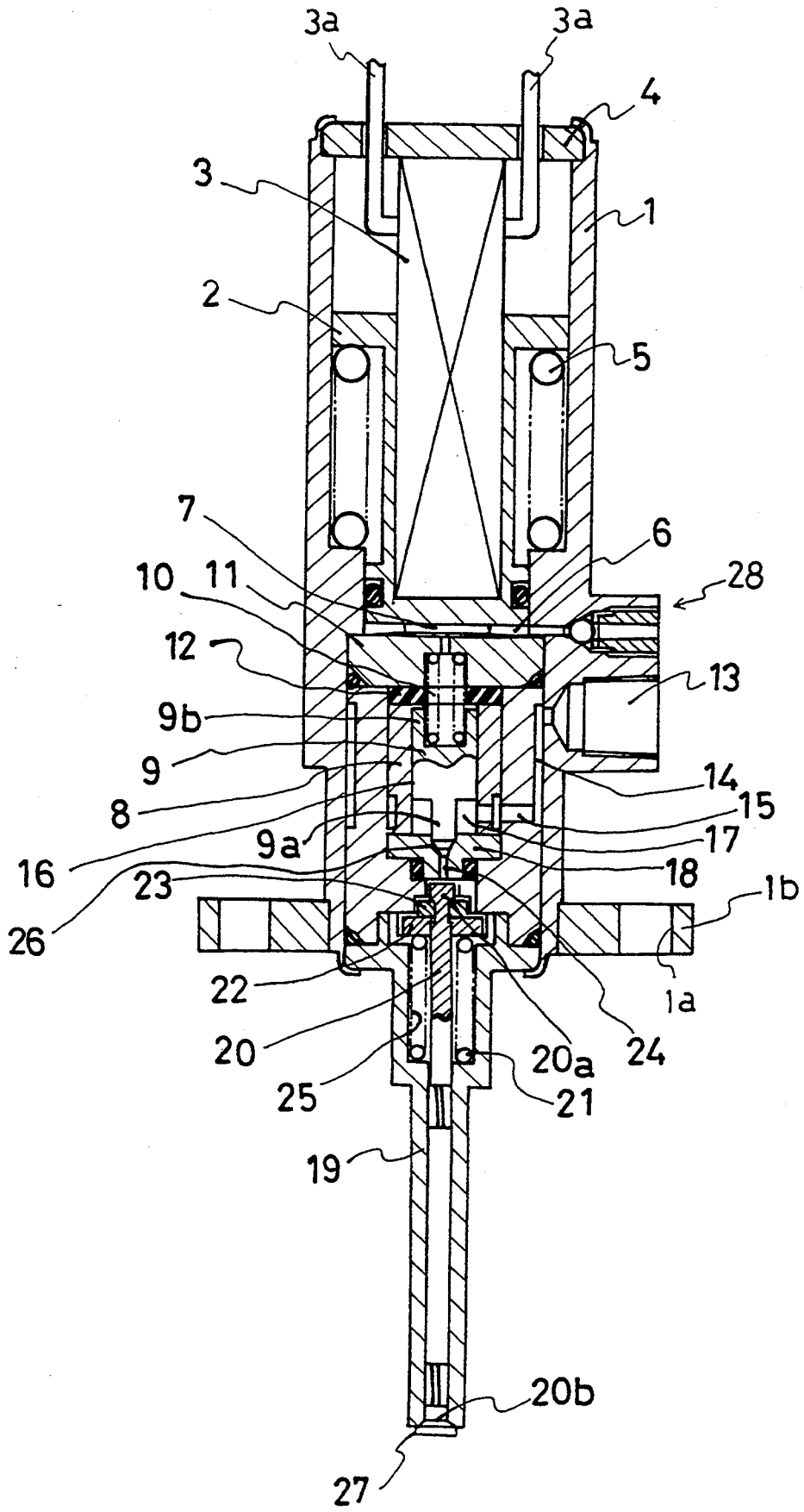
FIG. 1 is a vertical sectional view of a fuel injecting apparatus of the present invention.
Figure 2:
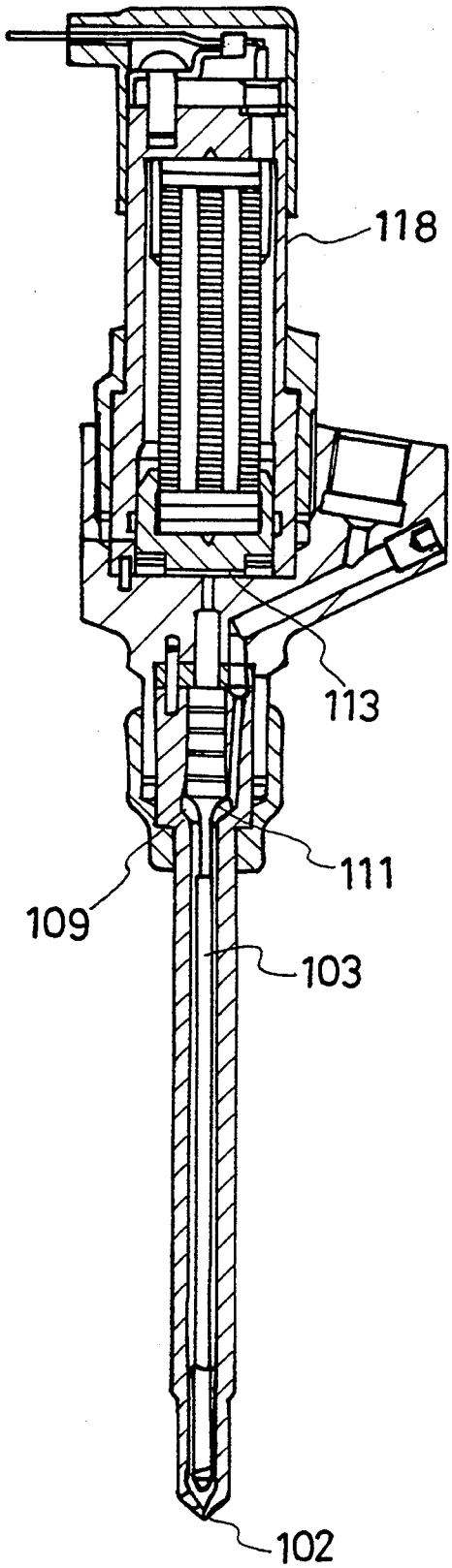
Fig2 (PRIOR ART)
FIG. 2 is a vertical sectional view of a prior art fuel injecting apparatus.

FIG. 1 shows a fuel injecting apparatus according to the present invention. The apparatus comprises, as shown in FIG. 1, a piston 2 disposed slidably in a housing 1 and an electrostrictive or piezoelectric actuator 3 with a pair of leading wires 3*a*. The actuator 3 is inserted in the piston 2 and is able to change its axial length. The actuator 3 is biased continually upward through the medium of the piston 2 by a spring force of a first spring 5 and a cone shaped disc spring 6, and is in contact with a cover 4 at an upper end portion of the housing 1. The housing 1 is provided at its lower end with a flange 1*b* in which a plurality of equally pitched holes 1*a* (only two are shown) and a plurality of bolts (not shown) pass the corresponding holes 1*a* for connecting the housing 1 to an engine (not shown).

A cylindrical sleeve 8 is fixed to the housing 1 under the piston 2, and a stepped plunger 9 having a projecting portion 9*a* and a receiving portion 9*b* is slidably inserted into the sleeve 8. A valve seat 18 having a valve surface 26 opposed to the projecting portion 9*a* is fixed to the housing 1 under the sleeve 8 and an orifice 24, as a measuring portion, is formed under the valve surface 26 in such a manner that a cross-sectional area of the orifice 24 is of a set value or constant determined diameter along the axial direction of the plunger 9. Thus, the amount of fuel to be injected depends on the foregoing area or diameter of the orifice 24. A second spring 10 is disposed between a spring seat 11 secured to the housing 1 and the receiving portion 9*b* of the plunger 9 so that the plunger 9 is in contact with the valve surface 26. A cylindrical distance piece or a spacer 12 is disposed between the spring seat 11 and the sleeve 8 so as to define a clearance or a gap between the spacer 12 and the the receiving portion 9*b* of the plunger 9. The plunger 9 is set to be movable for the extent of the resultant clearance. The spacer 12 also serves for regulating the uppermost position of the plunger 9 after its movement away from the seat 26.

A first fuel chamber 17 is defined between the plunger 9 and the valve seat 18 and is in fluid communication with a fuel entrance port 13 through passages 14 and 15. A slight annular clearance 16 is defined between an inner surface of the sleeve 8 and an outer surface of the plunger 9 in order that fuel passing through the clearance 16 can enter and fill a chamber 7 formed between a lower end of the piston 2 and the plunger 9.

A nozzle 19 having an injecting port 27 is fixedly mounted to the housing 1. An outward opening valve member 20 is slidably fitted in the nozzle 19 and a second fuel chamber 25 is defined between the housing 1 and the nozzle 19. The valve member 20 comprises an upper end portion 20*a* fixed with a stopper 23 and a lower end portion 20*b* exposed to an outer portion of the injecting port 27. The valve member 20 is biased upward to be in contact with the valve seat 18 by a third spring 21 by the medium of the stopper 23 and a spring seat 22 disposed under the stopper 23. Therefore, the orifice 24 is isolated from the second fuel chamber 25. In addition, the lower end portion 20*b* of the valve member 20 continually closes the injecting port 27 by the biasing force of a third spring 21 when the apparatus is out of operation. In other words, when the apparatus is not in operation, the valve member 20 serves for interrupting the fluid communication between the injecting port 27 and the engine. It is to be noted that, as apparent from the illustration, the lower end portion 20*b* is in engagement with the injecting port 27 in taper-to-taper fashion while the valve 20 is in a closed condition.

In the illustrated structure or embodiment according to the present invention, the actuator 3 is in fully charged condition under the continual preloading of the first spring 5 and the cone spring 6, which extends to the actuator 3. Under this condition, the fuel is supplied from the fuel entrance port 13 to the first fuel chamber 17 through the fuel passages 14 and 15, and the fuel pressure fills fuel in both the first fuel chamber 17 and the pressure chamber 7 through the clearance 16. Numeral 28 indicates a bleeding air mechanism used when the apparatus is mounted on the engine.

In operation, upon discharging of the actuator 3, the extended actuator 3 is brought into its shrinked condition, which results in a rapid decreasing of the pressure in the pressure chamber 7. Then, the projecting portion 9*a* of the plunger 9 moves, against the biasing force of the second spring 10, away from the seat 26, moves upward, and the receiving portion 9*b* of the plunger 9 is ultimately brought into engagement with the spacer 12.

Because of the connection of the first fuel chamber 17 to the orifice 24 as a result of the upward movement of of the plunger 9, the fuel filled in the first fuel chamber 17 is measured at the orifice 24. When the pressure of the fuel becomes a set value, the fuel, by urging the valve member 20 downward against the biasing force of the third spring 21, is fed to the second fuel chamber 25. The resultant fuel is then injected from the port 27.

As a result of the upward movement of the plunger 9, the fuel pressure in the pressure chamber 7 increases up to a value ultimately which is equal to that in the first fuel chamber 17. Under the resultant condition, as soon as the receiving portion 9*b* of the plunger 9 comes in contact with the spacer 12, a pressure receiving area of the plunger 9 which opposes to the first fuel chamber 7 becomes higher than a pressure receiving area of the plunger 9 which opposes to the pressure chamber 17, thereby moving the plunger 9 in the upward direction. Thus, further upward movement of the receiving portion 9*b* of the plunger 9 is prevented by the spacer 12, which results in that the opened condition of the valve is kept.

Next, upon establishment of the charged condition of the actuator 3, the extension thereof will move the piston 2 in the downward direction, thereby increasing the pressure in the pressure chamber rapidly. Then, the plunger 9 is moved downward away from the spacer 12 and comes in contact with the valve surface 26, resulting in the fluid communication between the first fuel chamber 17 and the second fuel chamber 25 being interrupted. Thus, due to the biasing force of the third spring 21, the the valve member 20 is moved upwardly for the closure of the valve which leads to the termination of the injection.

As a result of the downward movement of the plunger 9, fuel pressure in the pressure chamber 7 decreases finally to a value which is equal to that in the first fuel chamber 17 by downward movement of the plunger 9. Under the resultant condition, when the plunger 9 is moved away from the spacer 12, the plunger 9 is forced in the downward direction. The reason is that the area of the plunger 9 to which fuel pressure in the pressure chamber 7 is applied becomes higher than that of the plunger 9 to which fuel pressure in the first fuel chamber 17 is applied. Thus, finally, the projecting portion 9*a* of the plunger 9 is urged on the seat 26, which serves for maintaining the closed condition of the valve.

As described above, while the fuel injecting apparatus is out of operation the valve member 20 is set to close the injecting port 27 which ensures the interruption between the injecting port 27 and the combusting chamber of the engine. Thus, no unexpected fuel injection occurs upon combustion in the engine.

Furthermore the orifice 24 as the measuring portion is disposed away from the combustion chamber of the engine, which ensures the amount of fuel to be injected despite adhesion of carbon to the injecting port 27 and change in temperature in the burning chamber of the engine.

Having described a specific embodiment of the present invention, it is to be believed obvious that modification and variation of the present invention is possible in light of the above teachings.

What is claimed is:

1. A fuel injecting apparatus for injecting a quantity of fuel into an engine, comprising:

a housing;

a nozzle connected to the housing and extending into the engine;

a valve member slidably fitted in the nozzle and having an end portion extending outside of the nozzle and closing the nozzle when said valve member is fully inserted in said nozzle;

a first fuel chamber formed in said housing and connected to a source of high pressure fuel;

a second fuel chamber formed in said housing and communicating with said nozzle such that high pressure fuel in said second fuel chamber extends said valve member in said nozzle to open said nozzle;

a metering element disposed in said housing between said first and second fuel chambers for passing a metered quantity of fuel from said first fuel chamber to said second fuel chamber so as to extend said valve member and open said nozzle;

a plunger movably fitted in said housing and exposed to a pressing force of high pressure fuel from said first fuel chamber, said plunger being movable by said pressing force to a first position in which said plunger closes said metering element to prevent the passage of the metered quantity of high pressure fuel therepast; and a driving element in said housing, said driving element being actuatable to vary the pressing force of high pressure fuel on said plunger such that said plunger can move to and from said first position, whereby high pressure fuel may selectively be permitted to pass said metering element for injection into the engine.

2. A fuel injection apparatus as recited in claim 1, wherein the driving element comprises a piezoelectric actuator.

3. A fuel injection apparatus as recited in claim 2 including a pressure chamber positioned between said piezoelectric actuator and said plunger, said pressure chamber being fillable with high pressure fuel to provide said pressing force, wherein discharge of said piezoelectric actuator reduces the pressure of the high pressure fuel in said pressure chamber such that said plunger moves from said first position.

4. A fuel injecting apparatus as recited in claim 3, wherein high pressure fuel in said first fuel chamber acts on said plunger to move said plunger to said first position when said piezoelectric actuator is actuated.

5. A fuel injection apparatus as recited in claim 1, wherein the metering element comprises an orifice.

* * * * *